US008458846B2

(12) United States Patent
Schamberg et al.

(10) Patent No.: US 8,458,846 B2
(45) **Date of Patent: *Jun. 11, 2013**

(54) DEVICE FOR DENTAL AND/OR ORAL CARE

(75) Inventors: Stefan Schamberg, Usingen (DE); Jens Störkel, Frankfurt am Main (DE); Tilmann Winkler, Kronberg/Taunus (DE); Martin Vitt, Frankfurt am Main (DE); Ulrich Pfeifer, Münzenberg (DE)

(73) Assignee: BRAUN GmbH, Kronberg (DE)

( * ) Notice: Subject to any disclaimer, the term of this patent is extended or adjusted under 35 U.S.C. 154(b) by 775 days.

This patent is subject to a terminal disclaimer.

(21) Appl. No.: 12/597,608

(22) PCT Filed: Apr. 28, 2008

(86) PCT No.: PCT/EP2008/003444

§ 371 (c)(1),
(2), (4) Date: Oct. 26, 2009

(87) PCT Pub. No.: WO2008/131958

PCT Pub. Date: Nov. 6, 2008

(65) Prior Publication Data

US 2010/0125960 A1 May 27, 2010

(30) Foreign Application Priority Data

Apr. 27, 2007 (DE) ..... 10 2007 019 908

(51) Int. Cl.
*A46B 5/00* (2006.01)

(52) U.S. Cl.
USPC ..... 15/143.1; 15/167.1; 16/436; 16/DIG. 18; 16/DIG. 19

(58) Field of Classification Search
USPC ..... 15/143.1, 167.1, 187, 188; 16/436, 16/DIG. 12, DIG. 18, DIG. 19
See application file for complete search history.

(56) References Cited

U.S. PATENT DOCUMENTS

| | | | | |
|---|---|---|---|---|
| 87,070 A * | 2/1869 | Roberts | 15/188 |
| 726,727 A * | 4/1903 | Mills | 15/188 |
| 1,096,264 A * | 5/1914 | Palmer | 74/551.9 |

(Continued)

FOREIGN PATENT DOCUMENTS

| | | | |
|---|---|---|---|
| DE | 88 05 552 U1 | | 1/1989 |
| EP | 1025963 | * | 8/2000 |
| GB | 304 459 | | 1/1929 |
| JP | 2001-186926 | * | 7/2001 |

OTHER PUBLICATIONS

PCT International Search Report dated Aug. 22, 2008.

*Primary Examiner* — Mark Spisich
(74) *Attorney, Agent, or Firm* — Vladimir Vitenberg; George Henry Leal

(57) ABSTRACT

The invention relates to a device for dental and/or oral care, especially a tooth brush, comprising a preferably rod-shaped tool support to which a cleaning tool, especially a bristle field, can be fastened. The tool support is configured as a composite body that comprises an enveloping body from a first material, preferably plastic material, and a functional body from a second material, preferably metal, which is embedded in the enveloping body. The dental and/or oral care device is characterized in that the functional body is configured in at least some sections thereof as a trelliswork girder frame that has longitudinal girders substantially extending in the longitudinal direction of the tool support and a plurality of cross-girders. The enveloping body is especially transparent so that the functional body is visible through the enveloping body.

18 Claims, 9 Drawing Sheets

Figure 1:
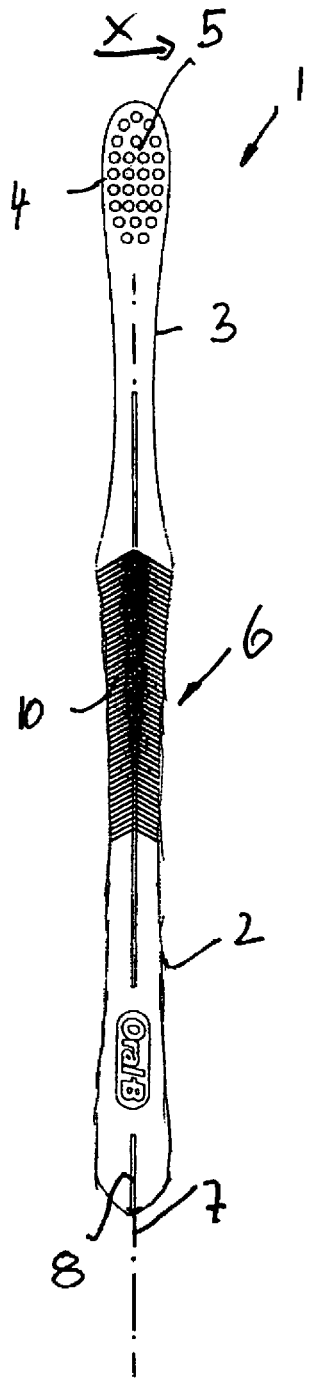

U.S. PATENT DOCUMENTS 1,903,161 A * 3/1933 Barkan ..... 15/188
4,263,691 A * 4/1981 Pakarnseree ..... 15/207.2
5,898,967 A * 5/1999 Wu et al. ..... 15/167.1
6,161,244 A 12/2000 Jeannet et al.
7,526,828 B2 5/2009 Kniese
2008/0148507 A1 6/2008 Kniese

* cited by examiner

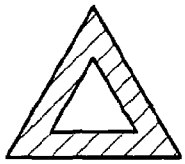
Fig. 10.1
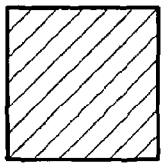
Fig. 10.2
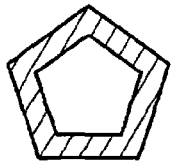
Fig. 10.3
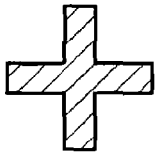
Fig. 10.4
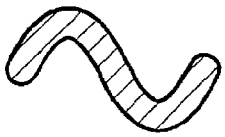
Fig. 10.5
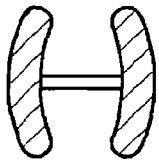
Fig. 10.6
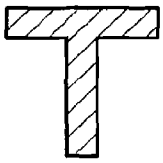
Fig. 10.7
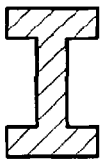
Fig. 10.8
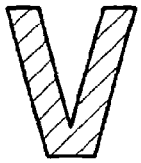
Fig. 10.9
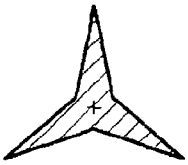
Fig. 10.10
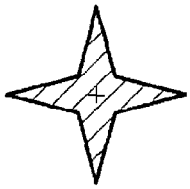
Fig. 10.11
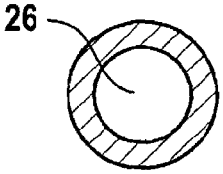
Fig. 10.12
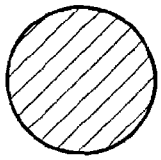
Fig. 10.13
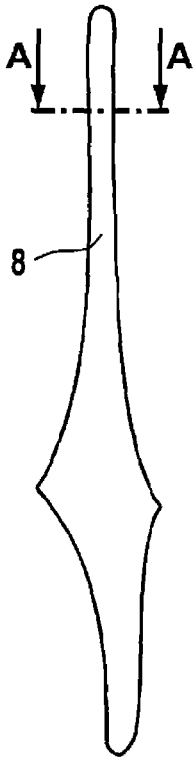
Fig. 9

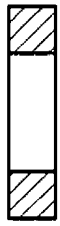
Fig. 11.1
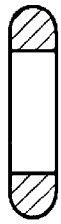
Fig. 11.2
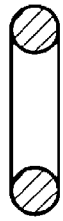
Fig. 11.3
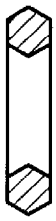
Fig. 11.4
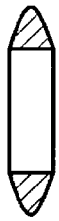
Fig. 11.5
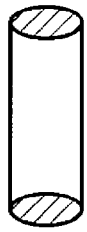
Fig. 11.6
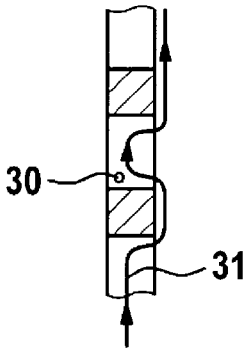
Fig. 12.1
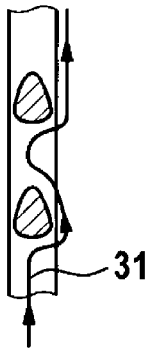
Fig. 12.2
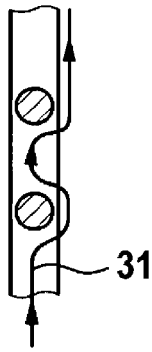
Fig. 12.3

DEVICE FOR DENTAL AND/OR ORAL CARE

The present invention relates to a device for dental and/or oral care, in particular toothbrushes, comprising a preferably approximately rod-shaped tool support, to which a cleaning tool, in particular a bristle field, can be fastened, wherein the tool support is formed as a composite body that comprises a enveloping body from a first material, preferably plastic material, and a functional body from a second material, preferably metal, which is embedded in the enveloping body, and to a method for producing it.

In the case of toothbrushes, their handles or the brush tubes or bristle head supports of brush attachments of electric toothbrushes typically have elongated, preferably approximately rod-shaped tool supports, which from the forces required during the cleaning operation, are more or less subjected to particular bending stresses due to the forces that are applied during the cleaning process. Other dental or oral cleaning devices, such as interdental cleaners, floss handles or tongue cleaners also have elongated tool supports, which are stressed in a similar way. In so far as such dental and oral cleaning devices are inserted into the oral cavity, these tool supporters must be formed in a slender way and are limited in terms of their possible cross sections, wherein, optionally curved or bent profiles can also be attained. However, in order to achieve the necessary strength, in particular bending strength, it was already proposed that the tool support be formed as a composite body, in which a strength-increasing reinforcement embedded in an enveloping body. Many different embodiments of the reinforcing body have been proposed to this effect.

Patent application GB 20 50 156 A1 proposes a manual toothbrush in which a metal strip is provided as a reinforcement in the handle and is embedded in a hard plastic enveloping body. The metal strip extends into the brush head, where it also serves to secure the tufts of bristles. However, the bond between the metal strip and the hard plastic envelope can present problems, among which is that the increase in strength attained is limited with regard to brush bending in the longitudinal center plane of the brush.

U.S. Pat. No. 4,829,621 proposes a manual toothbrush with a reinforcement body in the region of the neck of the toothbrush, which is intended to allow bending of the neck of the toothbrush in the longitudinal center plane of the brush and to fix the brush head in various bent positions, so to speak, so that different angles of the brush head can be employed. The reinforcement body is formed essentially rod-shaped.

Figure 4:
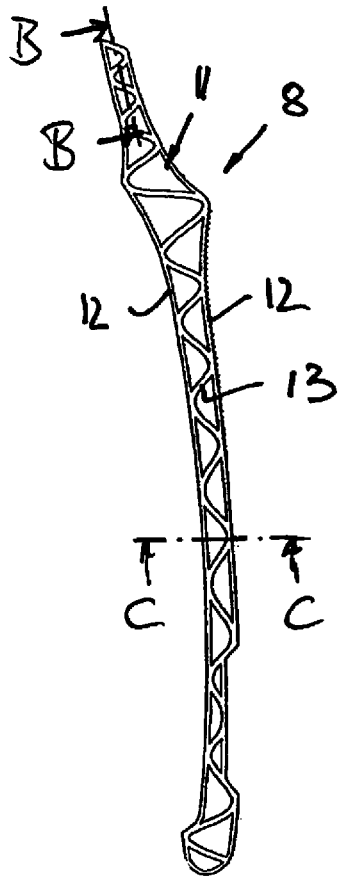

FIG. 4 of U.S. Pat. No. 3,857,134 proposes a toothbrush in the bristle support section of which a reinforcing plate of stiff material, such as steel or fiber-reinforced plastic, is embedded in a plastic enveloping body, wherein the reinforcement body is also used here for securing the bristle tufts.

From US 2004/170464, a toothbrush is also known in which reinforcing ribs are integrally formed on in the regions of the neck of the toothbrush and the back side of the bristle supports, in order to increase the bending strength of the toothbrush.

GB 231,753 also describes a manual toothbrush, in which an peripheral metal wire is embedded in the handle as reinforcement.

From GB 304,459, a toothbrush is also known whose handle is formed like a sandwich and has a plate-like reinforcement which is embedded in a celluloid enveloping body, wherein a wire mesh is proposed as the reinforcement.

Finally, US 2004/060138 describes a toothbrush whose handle is formed as a composite body, which has body sections of softer material and body sections of harder material that serve the purpose of strengthening, wherein at least some sections of the handle is intended to be comprised of transparent plastic.

The object of the present invention is to create an improved device for dental and/or oral care of the type defined at the outset, which overcomes the disadvantages of the prior art and further develops the prior art in an advantageous way. For such a dental and oral cleaning device, a lightweight, high-strength tool holder is preferably produced, which better withstands the typical brushing forces, but does not interfere with the functionality of the toothbrush and in particular allows the targeted elasticity and has a visually improved design.

In order to attain a high-strength and nonetheless lightweight reinforcement body on the one hand and a good bond between the reinforcing body and the enveloping body on the other hand, the present invention proposes that the reinforcing body is formed as a trelliswork girder frame in at least some sections, which has longitudinal girders extending essentially in the longitudinal direction of the tool support and a multiplicity of cross-connecting girders connecting the longitudinal girders to each other. A continuous discharge of tensile or compressive forces can be attained via the longitudinal girders, and moreover such a girder frame, in relation to its weight, is high-strength and rigid, in particular resistant to bending. Furthermore, the strength can be precisely controlled by the arrangement and distribution of the rods, in particular, different strengths and rigidities can be attained in different planes. In comparison to wire fabrics, warping that is typical in wire fabrics under diagonally acting forces virtually does not occur. Moreover, a good bond with the material of the enveloping body can be attained, since the envelope material penetrates the recesses in the girder system. Alternatively, the functional body is provided with cutouts, which are preferably all formed as openings. Once again, the recesses provide possibility means for mechanical bonding to the enveloping body.

The longitudinal girders of the girder frame may basically extend straight. However, in an advantageous development of the invention the longitudinal girders can be adapted in their profile to the outer contour of the enveloping body and deviate from the straight line at least in some sections thereof. Toothbrush handles often have, in particular for ergonomic reasons, a profile with multiple curved or angular bends so as to allow for a better grasping of the toothbrush and placement of the bristle field onto the teeth at a more favorable angle. Advantageously, the longitudinal girders of the girder frame are adapted to the outer contour—which is curved or angularly bent in the present case—of the enveloping body of the handle, such that they substantially follow the curvature or angular bends of the enveloping body.

In an advantageous development of the invention, the longitudinal girders are arranged on the edge of the girder frame, wherein it can, in particular, form the outer contour of the girder frame, so that the girder frame has a defined edge contour that, in particular, is adapted to the outer contour of the enveloping body. Generally, in addition to the peripheral longitudinal girders, additional longitudinal girders may be provided which likewise extend approximately in the longitudinal direction of the tool support. However, an advantageous embodiment of the invention can comprise the provision of longitudinal girders solely at the edges of the girder frame.

The longitudinal girders and the cross-connecting girders can in principle be connected to one another in various ways. According to a preferred embodiment of the invention, the girder rods and the crosswise connection rods can be joined together by being comprised of the same material. In particular, the entire girder frame and/or the entire reinforcement body can be integrally formed as one piece.

The longitudinal girders may be arranged essentially parallel to each other. Alternatively, the longitudinal girders may, however, also have a varying spacing between each other along their length. As a result, adaptation of the girder frame to an enveloping body cross section that may possibly vary in the longitudinal direction can be attained, and the available cross section can be optimally utilized. Alternatively or in addition, the strength and bending strength of the girder frame can however also be controlled in a targeted manner and varied over the length by means of a varying distance of the peripheral longitudinal girders.

Alternatively or in addition, the girder frame may have cross-connecting girders of different lengths, and/or cross-connecting girders positioned variably steeply relative to the longitudinal girders may be provided.

Alternatively or in addition to the aforementioned embodiment of the functional body in the form of a girder framework, the functional body can also have a meandering, wavy, step-like and/or zigzag profile, which essentially follows the length of the tool support. The reinforcement body can in particular comprise a profile support, which comprises the aforementioned course and an essentially constant cross section, wherein it is alternatively also possible to vary the cross section over the profile. This kind of meandering or wavy or otherwise oscillating profile of the reinforcement body can facilitate a targeted elastic embodiment of the tool support; moreover, a dissipation of stress in various layers of the enveloping body can be attained, since the bending stresses that occur in the reinforcement body are dissipated to different points on the enveloping body, and vice versa. Nevertheless, a reinforcement body with this kind of meandering or wavy profile, despite potentially high elasticity, attains high impact strength of the tool support. As a result, toothbrush necks in particular can be formed with sufficient impact strength to withstand the frequent impacts with the edge of a sink.

The aforementioned meandering or wavy or optionally zigzag profile of the reinforcement body is advantageously formed two-dimensionally or in other words flat. However, alternatively or in addition, the reinforcement body can also have alternating bulges in a third spatial axis in at least some sections. For example, the reinforcement body may comprise a profile screwed-together, for instance in the form of a wire bent in the shape of a helix.

The aforementioned oscillating and in particular meandering or wavy profile of the reinforcement body can, in a further development of the invention, have an amplitude that varies along the length; that is, the length of the bulges can vary transversely to the longitudinal direction of the reinforcement body, or in other words increase and decrease over the length. As a result, on the one hand, a targeted control of the strength and rigidity can be attained; on the other, an adaptation of the reinforcement body to what may be varying cross sections of the tool support can take place.

In order to control the desired contact pressure of the bristle field against the teeth to be brushed, but on the other hand to prevent gum irritations that result from often awkward brushing motions along the edges of the teeth onto the gums, the functional body embedded in the enveloping body can, in a further aspect of the present invention, be embodied such that its areal moment of inertia with respect to an axis perpendicular to the longitudinal center plane and plane of symmetry of the tool support amounts to a multiple, for example at least twice but also more than five times, of its areal moment of inertia with respect to an axis located in the aforementioned longitudinal center plane and plane of symmetry of the tool support. As a result, the desired bending strength of the handle or brush tube against sagging in the aforementioned longitudinal center plane and plane of symmetry is increased, whereas transverse bends are intentionally allowed or the elasticity in the transverse direction is hardly affected. As a result, the desired perpendicular contact pressure of the bristle field against the edges of the teeth can be controlled, while the brush head can bend out of the way, in up-and-down wiping motions along the side edges of the teeth, if the resistance is too high, for example at the gum line.

According to an advantageous embodiment of the invention, the embedded reinforcement body can essentially be formed in the shape of a plate and/or flat, wherein it is advantageously arranged essentially upright in the handle or brush tube of a toothbrush; that is, the reinforcement body has a maximum length in the longitudinal center plane and plane of symmetry of the toothbrush, which results in several of its length transversely to that longitudinal center plane and plane of symmetry.

However, in order to avoid an overly hard embodiment of the tool support and to intentionally allow the tool support section that carries the cleaning tool, in particular the bristle field, to bend out of the way, it may be provided in an advantageous embodiment of the invention that the reinforcement body ends before a tool securing section, and/or the tool securing section is formed reinforcement-free. If the tool support is a toothbrush tube or a toothbrush handle, then it can advantageously be provided that the reinforcement body ends before the bristle field. In particular, the reinforcement body can extend from the end opposite the bristle field to approximately the neck of the toothbrush.

In principle, only one functional body can be embedded in the enveloping body of the tool support, wherein advantageously, the functional body has a primary plane which is coplanar to the longitudinal center plane and plane of symmetry of the tool support. Alternatively, a plurality of functional bodies can, however, be embedded in the enveloping body; for example, two plate-shaped reinforcement bodies can be embedded in a toothbrush handle, to the right and the left of the longitudinal center plane.

Alternatively or in addition to the embodiment described above, the enveloping body of the tool support can be formed transparently in at least some sections in the region of the embedded functional body, so that the embedded functional body can be viewed through the enveloping body. This can, on the one hand, serve the purpose of controlling cracking, so that separations of the embedded functional body from the material comprising the sheathing body or even cracks in the functional body itself can be detected. On the other hand, advantageous visual effects can be attained hereby. For example, this allows at least some sections of the enveloping body transparent embodiments, while the embodiment of the enveloping body remains essentially the same, and thus in an injection-molded version without modifying the injection molding process, high productivity and in particular various visual embodiments of the toothbrush can be attained in a simple way. Inserting different functional bodies is all that must be done.

Alternatively or in addition, the enveloping body in its transparent section can also be advantageously formed as optically image-altering, in particular having a warping, distorting, enlarging, and/or shrinking effect. In an advantageous development of the invention, the enveloping body in its transparent section can, for example, form an optical lens, in particular to attain the effect of a magnifying glass. Advantageously, the enveloping body may also form an optical prism in its transparent section.

The embedded functional body and the enveloping body are advantageously formed differently, such that one body is at least partially opaque and the other body is at least partially transparent. In particular, the embedded functional body is opaque, so that it is visible through the enveloping body.

It is also the object of the invention to provide a method for producing a device for oral or dental care which permits a slender embodiment of a composite body.

Figure 2:
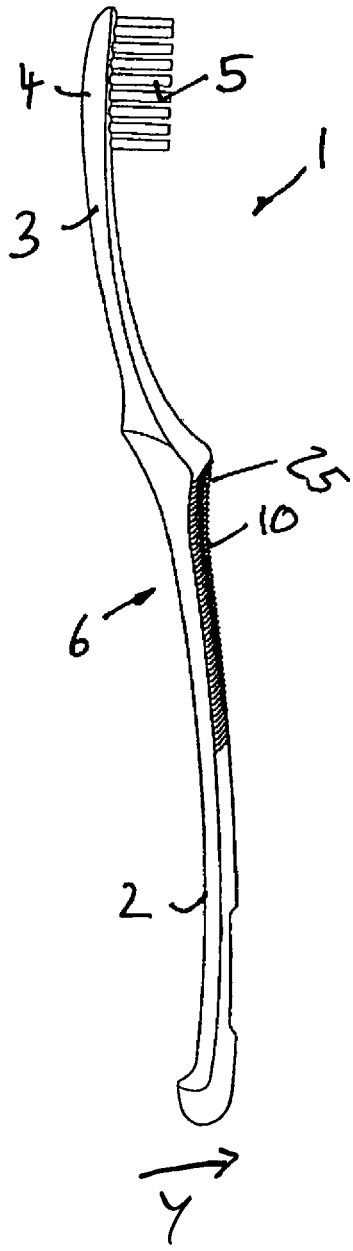
Figure 3:
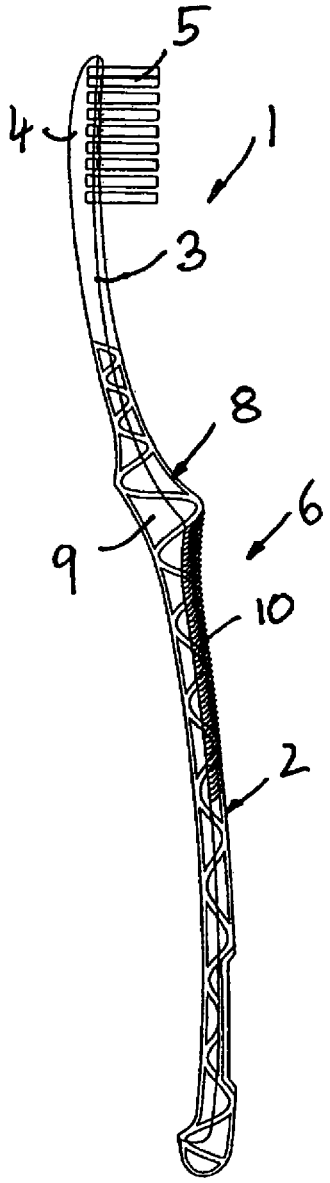
Figure 5:
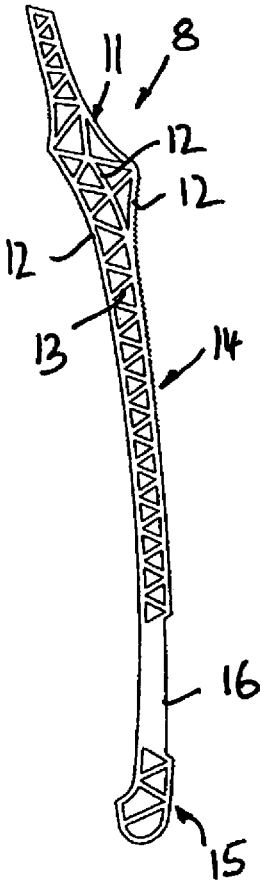
Figure 6:
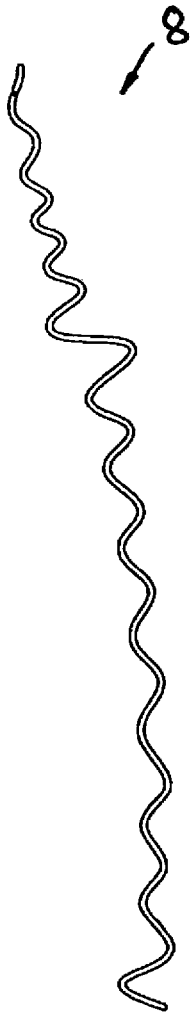
Figure 7:
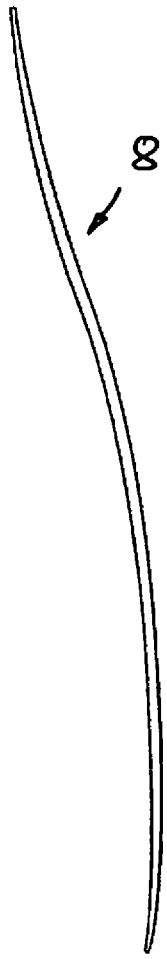
Figure 8:
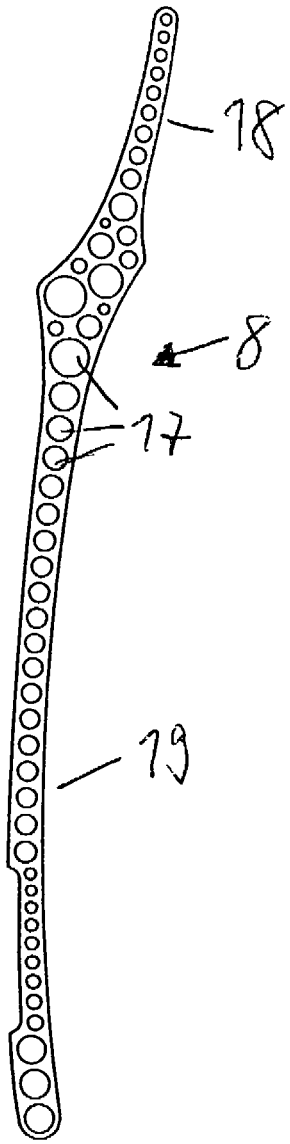
Figure 13:
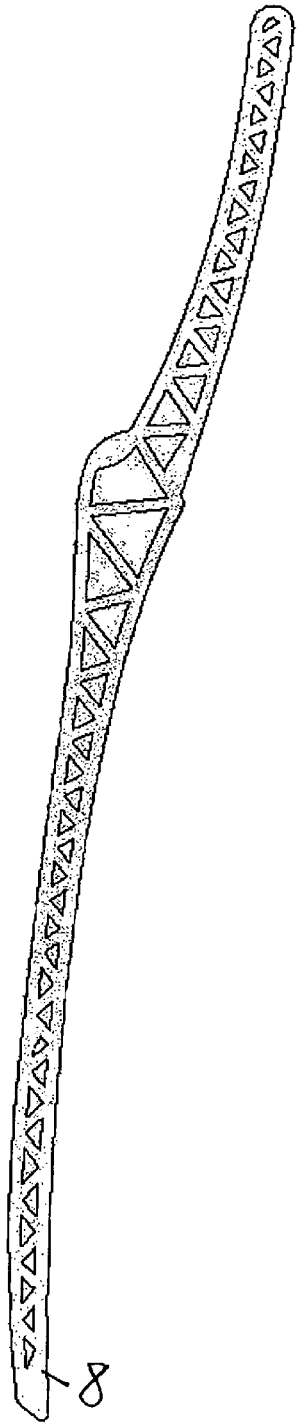
Figure 14:
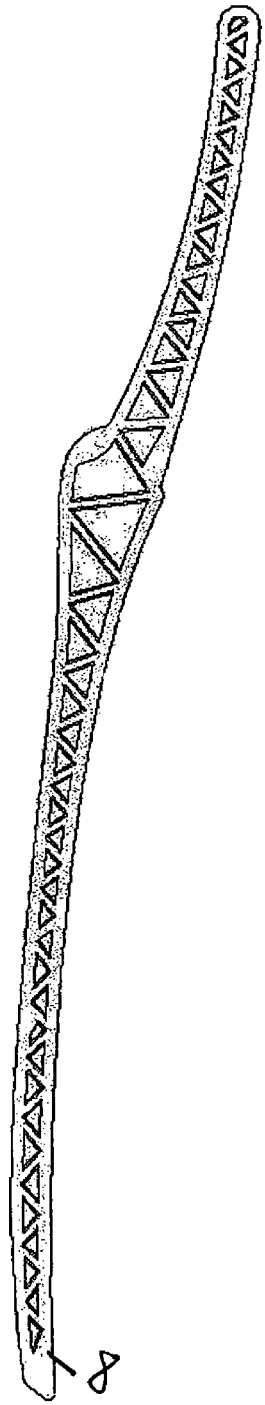
Figure 15:
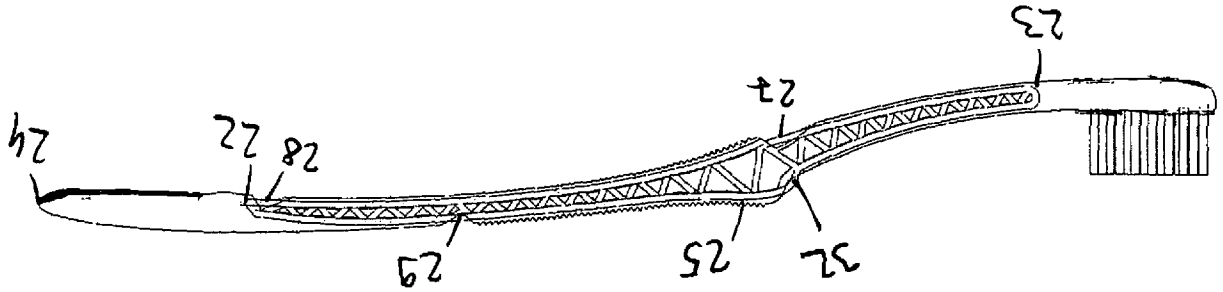
Figure 16:
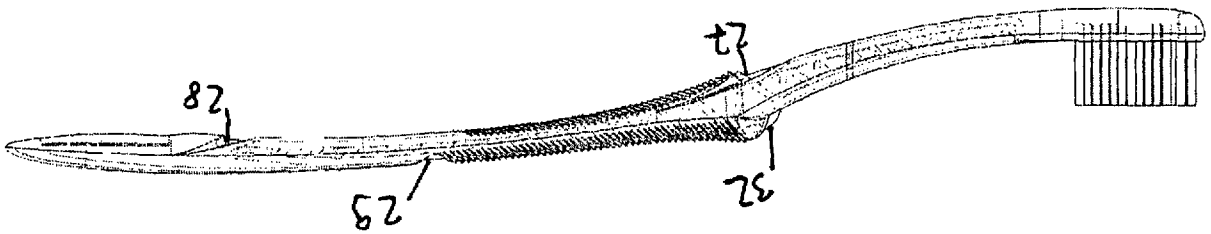
Figure 17:
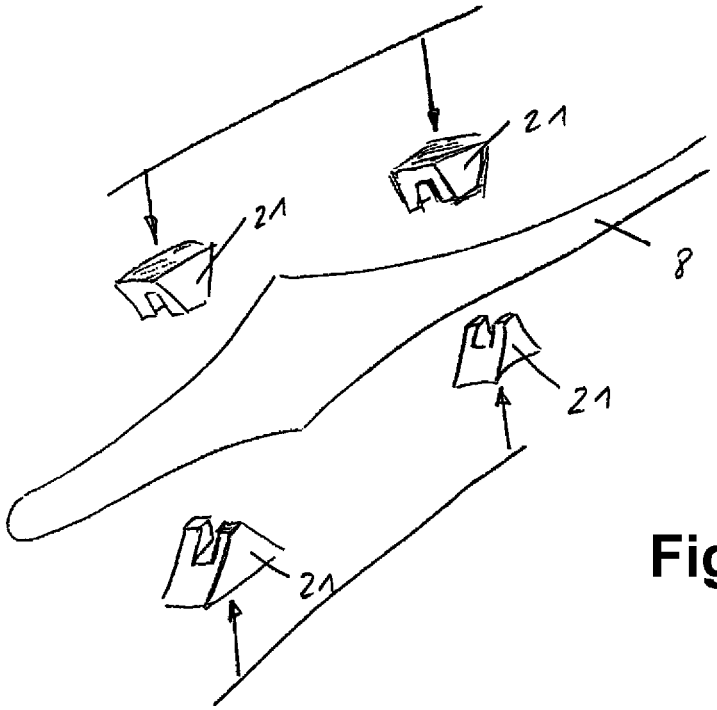
Figure 18:
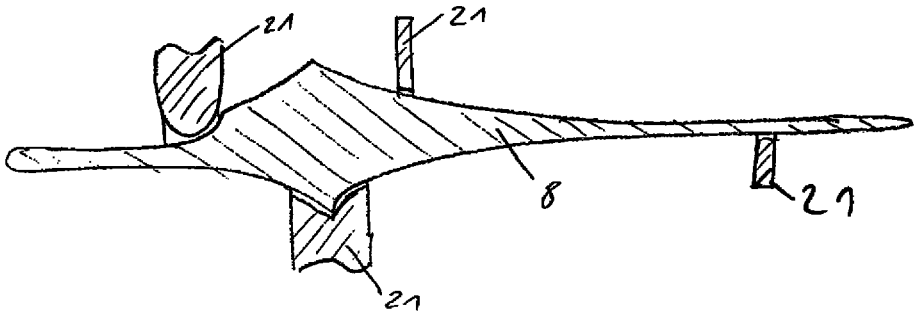

Additional characteristics, advantages, objects and possible applications of the present invention, or special embodiments thereof, will become apparent from the following description of the exemplary embodiments. All the characteristics described or shown in the drawings are the subject matter of the present invention on their own or in arbitrary combination and sub-combination, as well as independent of how they are summarized in the claims or the claims dependencies. The drawings show the following:

FIG. 1: a side view of a manual toothbrush, whose handle is formed as a composite body and has a reinforcement in the form of a girder frame;

FIG. 2: a side view of the toothbrush of FIG. 1;

FIG. 3: a side view of a toothbrush, similar to the previous drawings, whose handle is likewise formed as a composite body and has a reinforcement in the form of a girder frame, wherein the enveloping body is formed transparently and the embedded functional body is visible through the enveloping body;

FIG. 4: a side view of the embedded functional body of the toothbrush from FIG. 3;

FIG. 5: a side view of an embedded functional body according to an alternative embodiment for a toothbrush from FIGS. 1 through 3;

FIG. 6: a side view of an embedded functional body according to an alternative embodiment for a toothbrush from FIGS. 1 through 3;

FIG. 7: a side view of an embedded functional body according to an alternative embodiment for a toothbrush from FIGS. 1 through 3;

FIG. 8: a side view of an embedded functional body according to an alternative embodiment for a toothbrush from FIGS. 1 through 3;

FIG. 9: a schematic side view of a functional body for a toothbrush according to FIG. 1;

FIGS. 10.1 through 10.13: schematic cross-sectional views along the section line A-A in FIG. 9 for alternative embodiments of the functional body;

FIGS. 11.1 through 11.6: schematic sectional views through the section line C-C in the functional body according to FIG. 4;

FIGS. 12.1 through 12.3: schematic sectional views through the section line B-B in the functional body according to FIG. 4;

FIG. 13: a side view of an alternative embodiment of the functional body for a toothbrush according to FIG. 1 or FIG. 15;

FIG. 14: a side view of a further alternative embodiment of the functional body for a toothbrush according to FIG. 1 or FIG. 15;

FIG. 15: a side view of a toothbrush with a functional body according to FIG. 14 or FIG. 15;

FIG. 16: a side view of a toothbrush with a functional body according to FIG. 14 or FIG. 15;

FIG. 17: a schematic view of the tool holding device for supporting the functional body in the process of injection molding for a toothbrush according to any of the above drawings; and FIG. 18: a sectional side view of the functional body with the tool support device according to FIG. 17.

In FIGS. 1 and 2, a toothbrush 1 in the form of a manual toothbrush is shown, which has an overall rod-shaped handle 2, which transitions into a brush neck 3 and is connected by this to a brush head 4, to which a bristle field 5 is secured, optionally replaceable. Thus together with the brush neck 3, the handle 2 forms a tool support 6, which forms, in the region of the brush head 4, a tool securing section to which the aforementioned bristle field 5 is secured.

The handle 2 is slightly curved in an arch and has a varying cross section over its length in order to fit better in the hand. At the transition region between the handle 2 and the brush neck 3—in particular adjacent to and after the thumb rest 25 of the handle 3—a slight bend is provided. The aforementioned brush neck 3 is slightly curved in an arch in the opposite direction to the handle 2, so that the aforementioned tool support 6 has an overall slightly S-shaped contour. Overall, the tool support 6 is symmetrically formed, so that the plane of the drawing in FIG. 2 forms a longitudinal center plane and plane of symmetry 7 of the toothbrush 1. The toothbrush is curved outward in the handle region on the bottom side, and on the top side, which is the same side on which the thumb rest in the bristle field on the head are provided, it is provided with flat surfaces, preferably with roof-shaped surfaces.

Both the handle 2 and a section of the brush head 4 are formed as a composite body. A functional body 8 located on the inside, which is formed as a reinforcement body in the embodiment shown, is embedded in a enveloping body 9, in particular being joined materially, non-positively and/or positively to it, wherein the aforementioned functional body 8 is advantageously formed from a harder, stronger and/or firmer material, such as for example metal or plastic, and the enveloping body 9 comprises a softer, more impact-resistant and/or more-damping material. For example, the functional body may be formed from rust resistant metal, in particular steel, or from plastic material such as POM or liquid crystal polymer (LCP). In the case of a metal version, the functional body is produced by die-cutting or laser-cutting or by a chemical or electrochemical method, especially if cutouts are necessary. In the case of a plastic version for the functional body, it can likewise be produced by die-cutting or by injection molding. Preferably, the melting point of the plastic functional body is higher than that of the enveloping body. For example, the enveloping body 9 may be comprised of an injection-molded plastic, that is, preferably a plastic component, such as polypropylene or a copolyester (transparent), or—in a variation in combination with the hard component PP or another component or without such a component—with an (optionally transparent) elastomer (such as TPE). In the embodiment shown, the enveloping body 9 is not formed homogeneously in terms of material but rather is assembled from several sections or layers of material. A soft plastic layer can be applied to a hard plastic layer in some sections, for example by two-component injection molding. In the embodiment shown, the soft plastic section 10 located on the surface has surface striation. Alternatively, the section 10 is formed from the same component as the rest of the plastic enveloping body, so that the entire enveloping body is comprised of one component.

As FIG. 1 shows, the embedded functional body 8 can advantageously be formed as essentially plate-shaped or have a plate-shaped enveloping surface and can be arranged standing upright in the handle 2, wherein the functional body 8, in the version shown according to FIG. 1, extends essentially coplanar to the aforementioned longitudinal center plane 7 of the toothbrush 1. The embedded functional body 8 extends from the end of the handle 2 facing away from the bristle field 5 to approximately the center of the neck 3 of the brush or extending up to the brush head 4; there, however, the functional body 8 ends, so that a part of the brush neck 3 which adjoins the brush head 4 and the aforementioned brush head 4 itself are formed free of reinforcements. The variation of the functional body 8 according to FIG. 8 (which is selectively possible for the other alternatives of the functional body as well) preferably extends from the entire handle region 19 into the entire neck region 18 (up to before the brush head) or into the partial neck region 18 of the toothbrush. The aforementioned functional body 8 is shown separately in a side view in FIG. 4. In the embodiment shown, it forms a flat girder frame according to the style of trelliswork, wherein two longitudinal girders or chord members 12, which extend essentially in the longitudinal direction of the handle 2 or brush neck 3, are arranged along the edges of the girder frame 11 or form the edges of the girder frame 11, and several cross-connecting girders 13 are provided between the aforementioned longitudinal girders 12 and connect them to each other. In the embodiment shown, cross-connecting girders 13 are arranged at an acute angle to the longitudinal girders 12, so that viewed overall, the result is - in rough terms - a snakelike course of the cross-connecting girders 13. The longitudinal girders 12 together with the cross-connecting girders 13 can be advantageously, formed from the same material; for example, the girder frame 11 can be die-cut from a sheet of metal.

As FIG. 4 shows, the longitudinal girders 12 are adapted in their profile to the outer contour of both the handle 2 and the brush neck 3. They essentially follow the curved or bended profile of the outer contour in longitudinal section of the aforementioned handle 2 and brush neck 3. As a result, the longitudinal girders 12 vary in their spacing from each other along the length of the toothbrush. The cross-connecting girders 13 are correspondingly formed in different lengths in different longitudinal sections of the handle 2, and for example are especially long in the region of the bend between the handle 2 and the brush neck 3; see FIG. 4.

A similar structure of the embedded functional body 8 is shown in the embodiment of FIG. 5. Once again, the functional body 8 forms a girder frame 11, however, only in some sections. In particular, between two sections 14 and 15, which are formed as a girder frame 11, a section 16 is provided, in which the functional body 8 is embodied in the form of a solid strip or a solid plate without cutouts. Furthermore, the embodiment according to FIG. 5 shows that the girder frame 11, at least in some sections, can have more than two longitudinal girders 12. In the transitional region between the handle 2 and the brush neck 3, three longitudinal girders 12 are provided in the embodiment shown according to FIG. 5.

As FIG. 6 shows, the embedded functional body can also be formed in the shape of a meandering or wavy or oscillating snake. In the embodiment shown, the functional body 8 comprises a profile beam with an essentially constant cross section, in the form of a wire which essentially follows the length of the handle 2 and brush head 4, but bulges back and forth relative to that longitudinal extent, resulting in an oscillating profile whose center line essentially follows the curved longitudinal extent of the handle 2 and brush neck 3.

As in the embodiments shown above, the functional body 8 shown in FIG. 6 also extends essentially from the end of the handle 2 facing away from the brush head 4 to approximately the middle of the brush neck or up into the brush head 4.

One further possible embodiment of the embedded functional body 8 is shown in FIG. 7, in which the functional body 8 essentially comprises a rod-shaped profile support, but whose cross section varies in the longitudinal direction. In particular, the cross section decreases toward the ends, while a middle portion of the functional body 8 has an enlarged cross section compared to the end sections. The rod-shaped functional body 8 according to FIG. 7 has an overall slightly S-shaped curved profile, which essentially follows the correspondingly curved profile of the longitudinal extent of the handle 2 and of the brush neck 3.

FIG. 8 shows a further variation of the functional body 8. The functional body is formed in a plate-shaped metal body with cutouts in the form of circular openings. Here, round cutouts (required for the tool) can be produced more easily.

The enveloping body 9 of the tool support 6 may advantageously, be formed transparently, as shown in the embodiment according to FIG. 3. As a result, the embedded functional body 8 is visible through the enveloping body 9, thus making it possible to observe the embedded functional body 8 and to achieve special optical effects. In particular, great visual variety for the product can be attained without having to change the injection molds for the enveloping body 9. All that has to be done is for differently formed functional bodies 8, for example as shown in FIGS. 4 through 7, to be placed in the mold. A magnifying glass effect is advantageously created as a result of the shaping of the handle cross section.

FIG. 9 shows schematically in a side view a functional body 8 which can have any arbitrary shape of cutouts or trellis-shaped layout, or may have no cutouts at all.

FIGS. 10.1 through 10.13 show schematic variations of the cross-sectional field of the functional body at the point of the section line A-A in FIG. 9. It is understood that these cross-sectional views in FIGS. 10.1 through 10.13 exist preferably over the entire length of the functional body 8, and not only at the point of the section line A-A shown in FIG. 9, or as in the embodiment according to FIG. 7 vary over their length. Deviations in the section can occur in particular as a result of the type of cutouts in FIG. 9, since these cutouts are not further shown or taken into account in FIGS. 10.1 through 10.13 even though they may exist. According to FIGS. 10.1 through 10.3, the cross-sectional shape of the functional body is formed in the shape of a polygon. The cross section may form a triangle, a quadrilateral, in particular a square, a pentagon, or a polygon with additional sides. According to FIGS. 10.4 through 10.6, the cross-sectional area is formed in specific geometric shapes, such as a cross (FIG. 10.4), a wave (see FIG. 10.5), or in the form of two plate-shaped bars standing upright, which in particular are connected to a crossbar, so that the overall shape of an H in the cross-section is formed. Alternatively, the cross-sectional geometry of the functional body is T-shaped according to FIG. 10.7, I-shaped or in the shape of a double T in FIG. 10.8, and V-shaped in FIG. 10.9. According to FIGS. 10.10 and 10.11, the cross-sectional geometry of the functional body is formed in a star-shape with points, wherein n (the number of points)=2 to approximately 8. What is shown is a star shape with three points and with four points. Also alternatively, the cross-sectional shape of the functional body according to FIGS. 10.12 and 10.13 is circular and elliptical, respectively, wherein, selectively, excavation hollow space 26 is provided in the circular profile. All these cross-sectional profiles of the functional body shown as a side view can be combined arbitrarily with various geometries of cutouts of the functional body in. In all the embodiments of the functional body, the bending strength and/or a areal moment of inertia of the functional body with respect to an axis perpendicular to a longitudinal plane of symmetry 7 of the tool support 6 is a multiple of a bending strength and/or a areal moment of inertia of the functional body 8 with respect to an axis which is located in the aforementioned longitudinal plane of symmetry 7. It is thereby assured that adequate bending strength and an adequate surface moment of inertia exist in the neck 3 and the handle region 2, despite an extremely low structural height of the tool support and without further reinforcement provisions in the tool support, when the brush head is subjected to a force in a direction toward the back side of the bristle field 5, as is typical in the tooth brushing process.

FIGS. 11.1 through 11.6 show various cross-sectional geometries of the functional body 8 along the section line C-C in the functional body according to FIG. 4. Thus cross-sectional shapes of the functional body in a direction transverse to the inflow direction of the plastic of the tool support 6 in the injection molding process may deviate from the polygonal embodiment according to FIG. 11.1 to a rounded, circular, oval or more-polygonal cross-sectional form. FIGS. 12.1 through 12.3 show cross-sectional shapes which are likewise formed as circular, drop-shaped or rounded in some other way (see in particular FIGS. 12.2 and 12.3), so that turbulence-free injection and inflow are possible in the flow direction of the injected plastic for the enveloping body 9. The flow direction is symbolically represented in FIGS. 12.1 through 12.3 by the direction of the arrow 31. In FIG. 12.1, the formation of a bubble or contraction cavity 30 is indicated, since the cross-sectional profiles here are not rounded. The further-optimized embodiments according to FIGS. 12.2 and 12.3 are thus optimized so as to prevent the formation of bubbles upon injection/inflow of the enveloping body 9. The cross sections can be combined with any type of function support with all possible cutouts or without cutouts and with any cross sections according to FIGS. 10.1 through 10.13.

FIG. 13 shows the side view of a functional body 8 with a trelliswork structure, which is somewhat modified from that in FIG. 4, wherein the cross sections of the trellis girders are formed as in FIGS. 11.1 and 12.1. FIG. 14 shows an alternative embodiment to FIG. 13 of the functional body 8 in side view, wherein the cross-sectional areas on the outer contours according to FIG. 11.1 and the trellis girders in the inner region according to FIG. 12.3 are formed in rounded shapes. Thus in the embodiment according to FIG. 14, optimization to counteract bubble formation is attained in the direction of the melt flow upon injection of the plastic component for the enveloping body 9. The two examples according to FIGS. 13 and 14 also clearly show that arbitrary combinations of the cross-sectional shapes according to FIGS. 11 and 12 can be made. Preferably, sections of the functional body 8 which, when there is a cutout, have a transverse component to the longitudinal direction of the toothbrush (thus also predominantly in the melt flow direction) are provided with rounded edges.

FIGS. 15 and 16, in side view, show toothbrushes in which the functional bodies 8 are inserted for example either as in FIG. 13 or as in FIG. 14. In the view according to FIG. 15, the functional body is shown as a visible part, and in the view according to FIG. 16, the surrounding material of the enveloping body 9 is shown as a visible part. It can thus be seen particularly from FIG. 15 that the rear end 22 of the functional body need not necessarily extend as far as the rear end 24 of the handle 2, since bending forces in the rear portion do not play any essential role in daily use of the toothbrush. Thus the functional body 8 extends over at least half or two-thirds of the handle 2, beginning at the thumb rest 25, in the direction toward the rear end 24 of the enveloping body of the toothbrush. In the other longitudinal direction toward the bristle field, the functional body extends with the front end at least up to one-third of the way from the thumb rest 25 to the neck portion, as is shown, for example, in FIG. 3. Alternatively, an extension as far as the bristle field, or in a variation to beneath the bristle field into the head region (not shown), is also possible. Preferably, the functional body 8 extends its front end 23 over the entire neck portion 3 or over at least one-third of the length.

The toothbrush with one of the above functional bodies is preferably produced as follows. In the production, individual parts of the method or combinations of method characteristics, optionally with device characteristics, likewise form an independent subject matter of the invention. In a first step, the functional body is produced as a metal part or plastic body, in particular for example as die-cut or injection molded, as already described above. In a second step, the functional body is placed in an injection mold and secured. In a third step, the functional body is spray-coated in the mold with one or more plastic components of the enveloping body. Securing the bristles is done afterward or beforehand according to one of the known methods.

Securing the functional body in the mold can be carried out in various ways. In a first variation, the functional body has locating tabs, in particular protruding toward the contour, on which the securing in the injection mold takes place. These tabs are later removed after the spray-coating with the enveloping body, for instance at breaking points, or are sprayed over with a further component. In a second variation, the securing takes place at free areas 27, 28, 29 and 32 that are not spray-coated with the enveloping body 9 but whose contour largely extends or supplements the contour of the enveloping body. This variation is shown in FIGS. 15 through 18. Thus the enveloping body 9 has cutouts which correspond to the free areas 27, 28, 29 and 32 and at which, once the spray-coating of the enveloping body 9 is completed, the functional body 8 stands out visibly and perceptibly and is exposed. FIGS. 17 and 18 schematically show how the functional body 8—in this case—is clamped and secured by two upper and two lower holding jaws 21. The holding jaws are integrated with the injection molding process as part of the injection mold. In a further subvariation, the cutouts are spray-coated and filled up with a further component. According to a third variation, securing the functional body 8 in the injection mold is done by means of a lateral extension (not shown) of the functional body 8, which permits the functional body 8 to be clamped in the mold or supported in the mold in a way preventing against rotation and shifting. For that purpose, the functional body 8, for example, especially at its end sections, can be formed not as lying in the longitudinal plane of symmetry 7 but rather support itself on both side regions of the enveloping body, for example in wavy or meandering shape. The cross sections in FIGS. 10.1 through 10.13 also favor this kind of supporting in the mold.

In the case of a functional body 8 comprising plastic, the toothbrush, in a further tool concept, can also be made with injection molding steps in direction succession, for example with a rotating mold. In a further variation, the functional body is provided as predominantly upright in the neck 3 and handle region 2 and coplanar with the longitudinal plane of symmetry and rotated by 90° in the head, so that it is possible to secure it to the side faces of the head tool section. The function support shown in the drawings is sprayed-over with the enveloping body 9 at a height Y (see FIG. 2) in the longitudinal plane of symmetry 7 of up to 0 to 2 mm, in particular 0.05 to 1.5 mm, in particular 0.1 to 1 mm, and in particular 0.4 to 0.8 mm. Accordingly, the functional body is only barely covered by the top and bottom side of the toothbrush (aside from possible free areas). Preferably, the functional body 8 is enveloped or spray-coated—mostly or almost completely or entirely completely—toward the side surfaces or side edges, or in the transverse extension X (see FIG. 1) to the longitudinal axis of the toothbrush 6 with a spacing which amounts to from 2 to 15 mm, in particular 2 to 6 mm, per side. Thus virtually the entire extension or at least 80% of it in height from the top to the bottom side of the toothbrush is used to ensure the necessary bending strength and safety against breaking in this direction. In the transverse direction X, however, the functional body extends over in particular only less than 5 to 15% of the total length from side to side of the toothbrush. Thus by means of the embodiments described above, unusual toothbrush geometries can be achieved, with an enveloping body that is overall slender and in the Y extension in the handle region 2 is predominantly more slender than in the transverse direction X to that. Thus it is even possible to provide constrictions in the handle region and/or in the neck region in a way that otherwise can no longer be attained (see FIGS. 1 and 2) without compromising the sturdiness of the toothbrush.

What is claimed is:

1. A device for dental and/or oral care, comprising a tool support, on which a cleaning tool can be secured, the cleaning tool including a bristle field comprising cleaning elements extending therefrom generally in a first direction that is substantially perpendicular to a longitudinal direction of the tool support, wherein the tool support is formed as a composite body including an enveloping body having an outer contour and comprising a first material and a functional body comprising a second material embedded in the enveloping body, wherein the functional body comprises an essentially flat structure oriented in a plane substantially parallel to the first direction, the functional body having a plurality of cutouts therethrough so that the functional body is formed as a trelliswork girder construction having a pair of longitudinal peripheral girders extending essentially in the longitudinal direction of the tool support and several cross-connection rods disposed at acute angles relative to and between the longitudinal girders thereby interconnecting said longitudinal girders.

2. The device according to claim 1, wherein the girder construction is formed as a reinforcing girder frame.

3. The device according to claim 2, wherein the longitudinal girders form an outer contour of the girder frame.

4. The device according claim 2, wherein the girder frame is formed integrally as one piece of homogeneous material.

5. The device according to claim 2, wherein the functional body comprises a material which has a higher strength and/or rigidity than the material comprising the enveloping body.

6. The device according claim 1, wherein the longitudinal girders are adapted in their course to the outer contour of the enveloping body and at least in some sections have a profile deviating from straight.

7. The device according to claim 1, wherein the longitudinal girders have a varying spacing from one another along their length.

8. The device according to claim 1, wherein the cross-connection rods are formed with different lengths and are positioned variously steeply relative to the longitudinal girders.

9. The device according to claim 1, wherein the functional body is formed such that an areal moment of inertia of the functional body with respect to an axis perpendicular to a longitudinal plane of symmetry of the tool support amounts to several areal moments of inertia of the functional body (8) with respect to an axis that is located in the longitudinal plane of symmetry.

10. The device according to claim 9, wherein the functional body has a maximum extension in the longitudinal plane of symmetry of the tool support, which amounts to several extensions of the functional body transversely to the said longitudinal plane of symmetry.

11. The device according to claim 1, wherein the tool support forms a brush barrel and/or a handle of a toothbrush, wherein the functional body ends before a bristle field securing section of the tool support and/or the bristle field securing section of the tool holder is formed reinforcement-free.

12. The device according to claim 1, wherein the enveloping body is transparent in at least some sections, so that at least a portion of the functional body is visible through the enveloping body.

13. The device according to claim 12, wherein at least a portion of the enveloping body, in its transparent section, is formed to have image-altering optical properties resulting in at least one of a warping effect, a distorting effect, an enlarging effect, and a shrinking effect with respect to at least a portion of the functional body visible therethrough.

14. The device according to claim 13, wherein the at least a portion of the enveloping body having the image-altering properties forms an optical lens.

15. The device according to claim 13, wherein the at least a portion of the enveloping body having the image-altering properties forms an optical prism.

16. The device according to claim 1, wherein the functional body is opaque.

17. The device according to claim 16, wherein the functional body is formed from metal.

18. The device according to claim 17, wherein the functional body is formed from steel.

* * * * *